US006892787B1

(12) United States Patent
Stretch

(10) Patent No.: US 6,892,787 B1
(45) Date of Patent: May 17, 2005

(54) SECURITY CLOSURE

(75) Inventor: Stewart Stretch, Perth (AU)

(73) Assignee: WA Security Products PTY LTD (AU)

( * ) Notice: Subject to any disclaimer, the term of this patent is extended or adjusted under 35 U.S.C. 154(b) by 91 days.

(21) Appl. No.: 10/362,566

(22) PCT Filed: Aug. 8, 2000

(86) PCT No.: PCT/AU00/00943

§ 371 (c)(1),
(2), (4) Date: Feb. 24, 2003

(87) PCT Pub. No.: WO02/12672

PCT Pub. Date: Feb. 14, 2002

(51) Int. Cl.[7] ..... E06B 9/24
(52) U.S. Cl. ..... 160/371; 160/395
(58) Field of Search ..... 160/371, 369, 160/395, 392, 398, 403; 49/50, 57

(56) References Cited

U.S. PATENT DOCUMENTS

| | | | | | |
|---|---|---|---|---|---|
| 1,487,335 | A | | 3/1924 | Jaeger | |
| 1,596,507 | A | * | 8/1926 | Otto | 49/459 |
| 1,698,064 | A | * | 1/1929 | Otto | 160/371 |
| 2,246,995 | A | | 6/1941 | Ingersoll et al. | |
| 2,255,581 | A | | 9/1941 | Ewing | |
| 2,325,500 | A | * | 7/1943 | Fosberg | 160/383 |
| 2,335,361 | A | * | 11/1943 | Schiller | 160/395 |
| 4,226,049 | A | | 10/1980 | Maust | |
| 4,969,291 | A | | 11/1990 | Camara | |
| 5,056,262 | A | | 10/1991 | Schweiss et al. | |
| 5,207,022 | A | | 5/1993 | Watt | |
| 5,620,036 | A | * | 4/1997 | Grous | 160/89 |
| 5,937,593 | A | | 8/1999 | White | |
| 5,953,860 | A | | 9/1999 | Morgan et al. | |
| 6,125,910 | A | * | 10/2000 | Pepperell et al. | 160/371 |

FOREIGN PATENT DOCUMENTS

| | | | |
|---|---|---|---|
| AU | 10919/76 | | 11/1977 |
| AU | 27 758/77 | B1 | 2/1979 |
| AU | 32244/78 | B1 | 7/1979 |
| AU | 43443/79 | A1 | 8/1980 |
| AU | 58859/80 | B | 11/1981 |
| AU | 26031/84 | B | 9/1984 |
| AU | 18527/88 | A | 5/1989 |
| AU | 68813/91 | B | 6/1991 |
| AU | 75062/91 | B | 3/1993 |
| AU | 71528/94 | B | 12/1994 |
| AU | 70345/94 | A | 3/1995 |
| AU | 25039/95 | B | 3/1996 |
| AU | 25040/95 | B | 3/1996 |
| AU | 199524001 | C | 3/1996 |
| AU | 199668121 | B2 | 4/1997 |
| AU | 27269/95 | B | 3/1998 |
| AU | 69068/98 | A | 7/1998 |
| AU | 71855/98 | B | 10/1998 |
| AU | 78792/98 | B | 10/1998 |
| AU | 199878780 | B2 | 2/1999 |
| AU | 199896060 | B2 | 2/1999 |
| AU | 199925046 | B2 | 9/1999 |
| AU | 199942351 | B1 | 7/2000 |
| DE | 373 0944 | | 3/1989 |
| DE | 422 5865 | A1 | 1/1996 |
| DE | 44 25 865 | A1 | 1/1996 |
| DE | 197 10 079 | A1 | 9/1998 |
| DE | 298 17 187 | U1 | 2/1999 |
| DE | 297 23 772 | U1 | 7/1999 |
| FR | 1198650 | | 12/1959 |
| GB | 896389 | A | 5/1962 |
| GB | 2 161 194 | A | 1/1986 |
| GB | 2 247 486 | A | 3/1992 |
| GB | 2 291 091 | A | 1/1996 |
| GB | 2 309 044 | A1 | 7/1997 |
| WO | WO 91/08368 | A2 | 6/1991 |
| WO | WO 94/20724 | A1 | 9/1994 |
| WO | WO 96/01936 | A1 | 1/1996 |
| WO | WO 99/42694 | A1 | 8/1999 |

* cited by examiner

*Primary Examiner*—David Purol
(74) *Attorney, Agent, or Firm*—Rothwell, Figg, Ernst & Manbeck, pc.

(57) ABSTRACT

A security closure comprising a frame (11) which defines the perimeter of the closure where the frame is adapted to be mounted across an opening, a perforate sheet element (13) supported by said frame (11) to close the space defined by the frame (11), said perforate sheet element (13) being formed of a non-expanded sheet material having a plurality of closely spaced apertures punched therein which are dimensioned to prevent insect access through the apertures.

42 Claims, 1 Drawing Sheet

SECURITY CLOSURE

BACKGROUND

This invention relates to security screens which may be applied over windows and/or doorways for the purposes of enabling ventilation through the window or door when open but to prevent the access of insects past or through the screen. In addition the closure needs to be resistant to destructive forces to prevent unauthorised access of persons past or through the screen and of airborne objects past or through the screen.

DISCLOSURE OF THE INVENTION

Throughout the specification the term opening shall be taken as including doorways, windows, skylights and the like. The invention relates to security closures which will extend across the opening to close the opening and supplement the function of an existing closure such as a door or window panel which is provided at the opening. In addition throughout the specification the term "perforate sheet element" is to be taken to include a mesh, a woven mesh, an expanded mesh and perforated sheet material.

Accordingly the invention resides in a security closure comprising a frame having an outer edge which defines the outer perimeter of the frame and further having an inner edge which surrounds an open portion of the frame, the outer edge of the frame being dimensioned such that in use the security closure is receivable across an opening to close the opening, a perforate sheet element received in the open portion of the frame to close the open portion, the edges of the sheet element being formed with a lip extending from one face of the sheet element, the inner edge of the frame formed with a recess having an entry extending across at least a portion of the width of the inner edge, the recess extending along the inner edge, the edges of the sheet element received within the recess such that the lip is located within the recess, an elongate locking member received within the recess outward of the lip, said locking member being clampingly engaged between the one face of the sheet element and the opposed face of the recess.

According to an alternative feature of the invention the perforate sheet element is formed of a woven mesh.

According to an alternative feature of the invention the perforate sheet element is formed of an expanded mesh.

According to one particular embodiment the elongate locking member is fixed in the recess at least in part, through the frictional inter-engagement between the locking member and the opposed face of the recess is.

According to another particular embodiment the elongate locking member is fixed in the recess at least in part through the inter-engagement of complementary formations provided on the opposed face of the recess and opposed faces of the locking member.

According to a preferred feature of the embodiment the complementary formations comprise serrated-like formations on the opposed face of the recess and opposed face of the locking member recess.

According to another preferred feature of the invention the engagement of the locking member in the recess is supplemented by fixing elements between the locking member and the frame. According to one embodiment the fixing elements comprise rivets.

According to a preferred feature of the invention the perforate sheet element is powder coated.

According to a preferred feature of the invention, the locking member substantially fills the space defined within the recess between the lip and the entry between the one face of the sheet element and the opposed face of the recess.

According to a further preferred feature of the invention the locking member is formed of increasing thickness to enable it in use to be wedgingly engaged between the opposed face of the recess and the one face of the sheet element.

According to a further preferred feature of the invention said perforate sheet element is formed of a non-expanded steel sheet having a thickness sufficient to withstand penetration as a result of impact by blunt objects and having a plurality of closely spaced apertures punched therein which are dimensioned to prevent insect access through the apertures and wherein the spacing of the apertures provides a substantially unrestricted view through the sheet element.

According to a preferred feature of the invention the apertures have a diameter of between 1.6 mm to 3.6 mm. According to a preferred feature of the invention the spacing of the apertures centre to centre is between 2.0 mm and 3.5 mm. According to a preferred feature of the invention the perforate sheet element is formed of stainless steel sheet. According to a preferred feature of the invention the thickness of the steel sheet is between 0.5 mm and 1.0 mm.

According to a preferred feature of the invention a layer of an electrical insulator is located over the lip and adjacent portion of the sheet element to be received between opposed surfaces of the sheet element and the locking member and the opposed surfaces of the sheet element and the recess. According to one embodiment the layer of electrical insulator comprises a strip formed of a plastics material which is an electrical insulator and which is received over the lip and adjacent the portion of the sheet element.

According to a preferred feature of the invention the lip extends for the full length of the edges of the sheet element.

In the application of the invention the opening takes the form of a window and the closure comprises a screen receivable across the window or alternatively the opening may comprise a doorway and the security closure can be selectively moved between an open and closed position across an opening.

The invention will be more fully understood in the light of the following description of several specific embodiments.

BRIEF DESCRIPTION OF THE DRAWINGS

The description is made with reference to the accompanying drawings of which.

DESCRIPTION OF SEVERAL SPECIFIC EMBODIMENTS OF THE INVENTION

Figure 1:
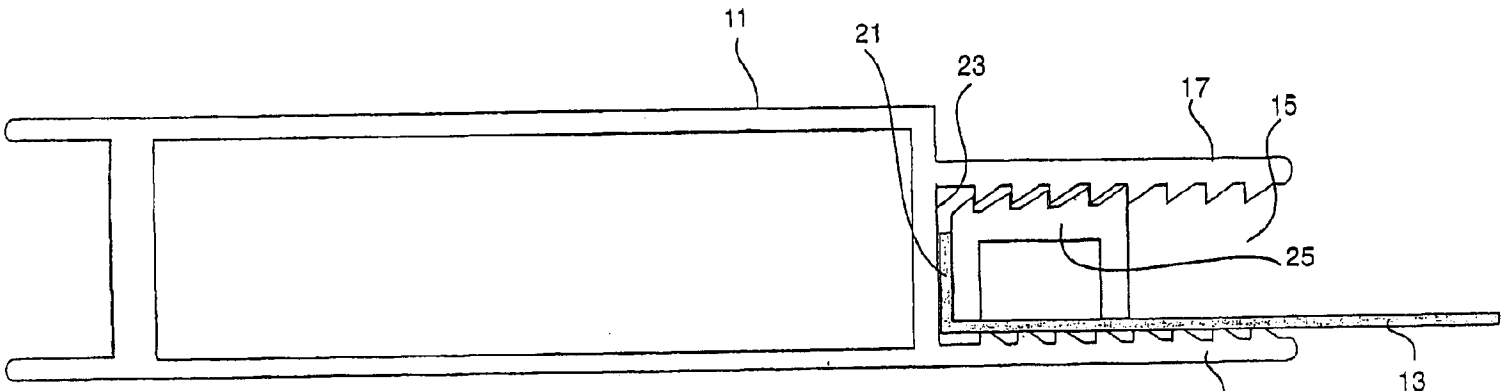
FIG. 1 is a schematic partial sectional elevation of a security closure according to the first embodiment illustrating the mounting of the sheet material to the frame.

The first embodiment as shown at FIG. 1 is directed to a screen closure which may comprise a screen which is applied across a window or alternatively may comprise a screen door where the closure is required to permit air flow through the window or doorway but to prevent the access of insects past or through the closure and to prevent unauthorised entry past or through the opening. The screen closure will supplement the existing closure associated with the opening.

The screen closure according to the first embodiment comprises a frame 11 which defines the perimeter of the closure and which is configured to be received in the window or door frame and is adapted to be fixed thereto in the most appropriate manner. The frame 11 is formed of a metal section formed of aluminium where the section is configured to support the edges of a screen 13 which is formed of perforated stainless steel sheet where the perforations are closely spaced and are dimensioned such as to prevent insect access through the apertures. The apertures are formed by punching. The screen material comprises a non-expanded sheet material. The apertures are dimensioned so as to prevent the passage of insects such as house flies and mosquitoes past or through them and are spaced sufficiently closely so as to provide a relatively unrestricted view through the screen when observed from a distance. In addition the grade and thickness of the stainless steel sheeting and the spacing of the apertures is such that the sheet is capable of withstanding significant impact forces created by sharp and blunt objects.

The inner edge of the frame 11 is formed with an inwardly directed recess 15 defined between a pair of flanges 17 and 19 where the entry into the recess extends across the inner edge of the frame. The edges of the screen material 13 are each formed with an upstanding lip 21. The lip is formed by bending the screen material at the edges and as a result the lip 21 extends form one face of the screen and is substantially perpendicular to the plane of the screen. In mounting the screen to the frame the edge of the screen 13 is received within the recess 15 such that the lip 21 is closely adjacent the base 23 of the recess 15. The screen 13 is retained in position in the recess by means of a elongate locking member 25 which is received between one flange 17 and the opposed face of the screen 13 such that the lip 21 is positioned between locking member 25 and the base 23. The opposed faces of the locking member and the one flange are each formed with a serrated profile where the profiles are complementary and each serration has an inclined face and an upright face and the serrations are arranged on each surface to permit movement of the locking member into the recess but to prevent movement of the locking member from the recess. The locking member 25 is dimensioned such that it will fill the space between the one flange 17 and the screen 13 and as a result will clampingly retain the screen 13 against the other flange 19. The inner face of the other flange 19 is also formed with a serrated profile of similar if not identical form to that of the one flange 17. In addition the serrated face of the locking member 25 is inclined with respect to the base of the locking member such that the locking member has a wedge shaped cross-sectional configuration and in use the side of the locking member having the reduced width is introduced into the recess first whereby with further introduction of the locking member into the recess the locking member becomes wedgingly engaged between the screen and the opposed face of the recess.

As a result of the first embodiment, a screen closure is provided which is secure in that the means of retaining the screen securely retains the screen in position in the frame without requiring any fixing or bolting of the screen material to the frame. In addition, the use of perforated non-expanded stainless steel sheet material provides a medium which can be more readily powder coated than screen materials which have been used in the past such as mesh or expanded sheet material. In this regard the powder coating which is applied to mesh sheet material and expanded sheet material can be the subject of cracking and resultant separation from the sheet material as a result of localised deflection of the sheet material which results in a spoiling of the appearance of the sheet material and can result in corrosion. In addition it has been found that the perforated sheet material can be harder to cut with a knife or similar sharp instrument when compared to some mesh or expanded sheet materials. The perforated sheet material also provides an aesthetically pleasing appearance.

Figure 2:
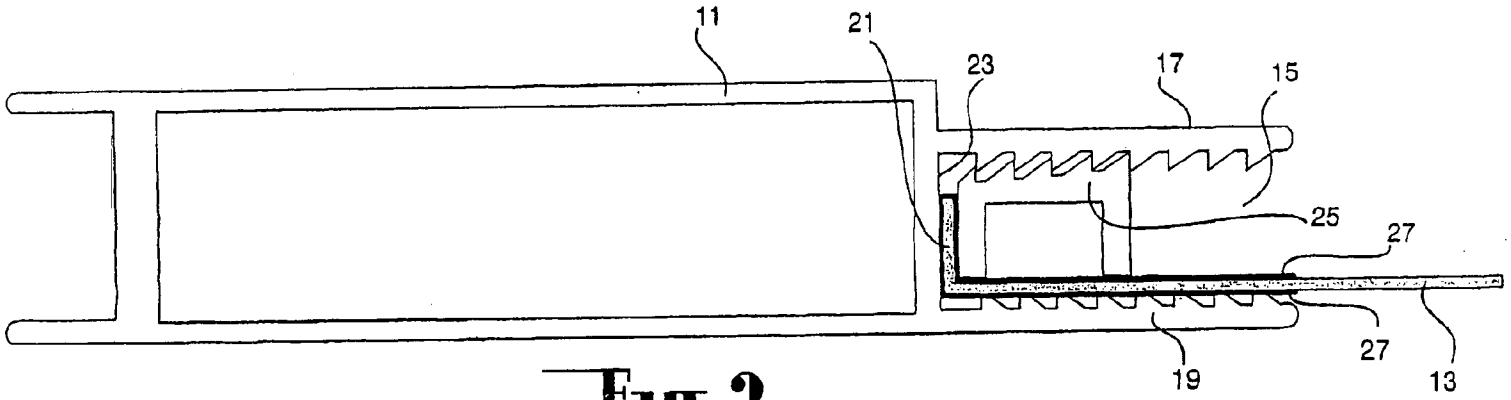
FIG. 2 is a schematic partial sectional elevation of a security closure according to the second embodiment illustrating the mounting of the sheet material to the frame.

The second embodiment as shown at FIG. 2 is of similar form to the first embodiment and as a result the same reference numerals have been used in relation to corresponding elements of the second embodiment. The second embodiment differs from the first embodiment in that it also includes a layer 27 of an electrical insulator which overlies the lip 21 and extends over at least the adjacent portion of each face of the screen 13 which will be received in the recess 15. The layer 27 is formed of a strip formed of a suitable plastics material and is preformed to the configuration of profile of the edge of screen. In assembly of the closure the preformed strip 27 is applied over the edge of the screen and the combination of edge and strip is introduced into the recess at which time the locking member is driven into place.

A first example of the second embodiment was constructed to provide a screen door 870 mm wide and 2040 mm long. The screen was formed of stainless steel sheeting 0.71 mm thick of 304 grade and the frame was formed of an aluminium section as shown at FIG. 2. The spacing between the apertures centre to centre in the stainless steel sheet was 3.1 mm and the diameter of the apertures was 2.06 mm. On testing the door in accordance with the requirements of Appendix A of AS/NZS 2803.1:1994, "Method of Test for Resistance to Forced Entry". The door held all required forces and remained a closed deterrent.

A second example of the second embodiment was constructed to provide a screen door 1250 mm wide and 2100 mm long. The screen was formed of stainless steel sheeting 0.71 mm thick of 304 grade and the frame was formed of an aluminium section as shown at FIG. 2. The spacing between the apertures centre to centre in the stainless steel sheet was 3.1 mm and the diameter of the apertures was 2.06 mm. On testing the door in accordance with the requirements of Appendix B of AS 2803.2:1995, "Method of Test for Resistance to Forced Entry". The door held all required forces and remained a closed deterrent.

A third embodiment of the invention is of similar form to the first and second embodiments with the exception that fixing of the locking member to the one flange is supplemented by the use of rivets which are used to fix the one flange to the locking member at spaced intervals along their length.

According to alternative embodiments of the invention the screen is formed of a stainless steel mesh of a suitable grade to provide apertures small enough to prevent insect access past or through the screen or an expanded stainless steel sheet material which provide apertures small enough to prevent insect access through the screen.

Throughout the specification, unless the context requires otherwise, the word "comprise" or variations such as "comprises" or "comprising", will be understood to imply the inclusion of a stated integer or group of integers but not the exclusion of any other integer or group of integers.

It should be appreciated that the scope of the present invention need not be limited to the particular scope of the embodiment described above.

What is claimed is:

1. A security closure comprising a frame having an outer edge which defines the outer perimeter of the frame and further having an inner edge which surrounds an open portion of the frame, the outer edge of the frame being dimensioned such that in use the security closure is receivable across an opening to close the opening, a perforate rigid sheet element received in the open portion of the frame to dose the open portion, the edges of the sheet element being formed with a lip extending from one face of the sheet element, the inner edge of the frame formed with a recess having an entry extending across at least a portion of the width of the inner edge, the recess extending along the inner edge, the edges of the sheet element received within the recess such that the lip is located within the recess, an elongate locking member received within the recess outward of the lip, said locking member being clampingly engaged between the one face of the sheet element and the opposed face of the recess.

2. A security closure as claimed at claim 1 wherein the elongate locking member is fixed in the recess at least in part, through the frictional inter-engagement between the the locking member and the opposed face of the recess.

3. A security closure as claimed at claim 1 wherein the elongate locking member is fixed in the recess at least in part through the inter-engagement of complementary formations provided on the opposed face of the recess and opposed face of the locking member.

4. A security closure as claimed at claim 3 wherein the complementary formations comprise serrated-like formations on the opposed face of the recess and opposed face of the locking member recess.

5. A security closure as claimed at claim 2 wherein the engagement of the locking member in the recess is supplemented by fixing elements between the locking member and the frame.

6. A security closure as claimed at claim 5 wherein the fixing elements comprise rivets.

7. A security closure as claimed at claim 1 wherein, the locking member substantially fills the space defined within the recess between lip and the entry between the one face of the sheet element and the opposed face of the recess.

8. A security closure as claimed at claim 2 wherein, the locking member substantially fills the space defined within the recess between lip and the entry between the one face of the sheet element and the opposed face of the recess.

9. A security closure as claimed at claim 3 wherein, the locking member substantially fills the space defined within the recess between lip and the entry between the one face of the sheet element and the opposed face of the recess.

10. A security closure as claimed at claim 7 wherein the locking member is formed of increasing thickness to enable it in use to be wedgingly engaged between the opposed face of the recess and the one face of the sheet element.

11. A security closure as claimed at claim 8 wherein the locking member is formed of increasing thickness to enable it in use to be wedgingly engaged between the opposed face of the recess and the one face of the sheet element.

12. A security closure as claimed at claim 9 wherein the locking member is formed of increasing thickness to enable it in use to be wedgingly engaged between the opposed face of the recess and the one face of the sheet element.

13. A security closure comprising a frame having an outer edge which defines the outer perimeter of the frame and further having an inner edge which surrounds an open portion of the frame, the outer edge of the frame being dimensioned such that in use the security closure is receivable across an opening to close the opening, a perforate rigid sheet element received in the open portion of the frame to close the open portion, the edges of the sheet element being formed with a lip extending from one face of the sheet element, the inner edge of the frame formed with a recess having an entry extending across at least a portion of the width of the inner edge, the recess extending along the inner edge, the edges of the sheet element received within the recess such that the lip is located within the recess, an elongate locking member received within the recess outward of the lip, said locking member being clampingly engaged between the one face of the sheet element and the opposed face of the recess and a layer of an electrical insulator received over the lip and adjacent portion of the sheet element to be received between opposed surfaces of the sheet element and the locking member and the opposed surfaces of the sheet element and the recess.

14. A security closure as claimed at claim 13 wherein the layer of electrical insulator comprises a strip formed of plastics material which is an electrical insulator and which is received over the lip and adjacent portion of the sheet element.

15. A security closure as claimed at claim 14 wherein the strip is preformed to the configuration of the profile of the lip and adjacent portion of the sheet element.

16. A security closure as claimed at claim 13 wherein the elongate locking member is fixed in the recess at least in part, through the frictional inter-engagement between the the locking member and the opposed face of the recess.

17. A security closure as claimed at claim 13 wherein the elongate locking member is fixed in the recess at least in part through the inter-engagement of complementary formations provided on the opposed face of the recess and opposed face of the locking member.

18. A security closure as claimed at claim 17 wherein the complementary formations comprise serrated-like formations on the opposed face of the recess and opposed face of the locking member recess.

19. A security closure as claimed at claims 16 wherein the engagement of the locking member in the recess is supplemented by fixing elements between the locking member and the frame.

20. A security closure as claimed at claim 19 wherein the fixing elements comprise rivets.

21. A security closure as claimed at claim 16 wherein, the locking member substantially fills the space defined within the recess between lip and the entry between the one face of the sheet element and the opposed face of the recess.

22. A security closure as claimed at claim 17 wherein, the locking member substantially fills the space defined within the recess between lip and the entry between the one face of the sheet element and the opposed face of the recess.

23. A security closure as claimed at claim 21 wherein the locking member is formed of increasing thickness to enable it in use to be wedgingly engaged between the opposed face of the recess and the one face of the sheet element.

24. A security closure as claimed at claim 22 wherein the locking member is formed of increasing thickness to enable it in use to be wedgingly engaged between the opposed face of the recess and the one face of the sheet element.

25. A security closure comprising a frame having an outer edge which defines the outer perimeter of the frame and further having an inner edge which surrounds an open portion of the frame, the outer edge of the frame being dimensioned such that in use the security closure is receivable across an opening to close the opening, a perforate rigid sheet element received in the open portion of the frame to close the open portion, the edges of the sheet element being formed with a lip extending from one face of the sheet element, the inner edge of the frame formed with a recess having an entry extending across at least a portion of the width of the inner edge, the recess extending along the inner edge, the edges of the sheet element received within the recess such that the lip is located within the recess, an elongate locking member received within the recess outward of the lip, said locking member being clampingly engaged between the one face of the sheet element and the opposed face of the recess wherein the elongate locking member is fixed in the recess at least in part through the inter-engagement of complementary formations provided on the opposed face of the recess and opposed face of the locking member and the locking member substantially fills the space defined within the recess between lip and the entry between the one face of the sheet element and the opposed face of the recess.

26. A security closure as claimed at claim 25 wherein the complementary formations comprise serrated-like formations on the opposed face of the recess and opposed face of the locking member recess.

27. A security closure as claimed at claim 25 wherein the locking member is formed of increasing thickness to enable it in use to be wedgingly engaged between the opposed face of the recess and the one face of the sheet element.

28. A security closure as claimed at claim 25 wherein a layer of an electrical insulator is received over the lip and adjacent portion of the sheet element to be received between opposed surfaces of the sheet element and the locking member and the opposed surfaces of the sheet element and the recess.

29. A security closure as claimed at claim 28 wherein the layer of electrical insulator comprises a strip formed of plastics material which is an electrical insulator and which is received over the lip and adjacent portion of the sheet element.

30. A security closure as claimed at claim 28 wherein the strip is preformed to the configuration of the profile of the lip and adjacent portion of the sheet element.

31. A security closure as claimed at claim 1 wherein said perforate sheet element is formed of a non-expanded steel sheet having a thickness sufficient to withstand penetration as a result of impact by blunt objects and having a plurality of closely spaced apertures punched therein which are dimensioned to prevent insect access through the apertures, wherein the spacing of the apertures provides a substantially unrestricted view through the sheet element.

32. A security closure as claimed at claim 31 wherein sheet element is formed of stainless steel sheet.

33. A security closure as claimed at claims 31 wherein the thickness of the steel sheet is between 0.5 mm and 1.0 mm.

34. A security closure as claimed at claim 33 wherein the apertures have a diameter of between 1.6 mm to 3.6 mm.

35. A security closure as claimed at claim 33 wherein the spacing of the apertures centre to centre is between 2.0 mm and 3.5 mm.

36. A security closure as claimed at claim 31 wherein the steel sheet is 0.71 mm thick of 304 grade stainless steel, the spacing between the apertures centre to centre is 3.1 mm and the diameter of the apertures is 2.06 mm.

37. A security closure as claimed at claim 1 wherein the sheet element is formed of a woven mesh.

38. A security closure as claimed at claim 1 wherein the sheet element is formed of an expanded mesh.

39. A security closure as claimed at claim 1 wherein the sheet element is powder coated.

40. A security closure as claimed at claim 1 wherein the opening is a window and the closure comprises a screen receivable across the window.

41. A security closure as claimed at claim 39 wherein the closure can be selectively moved between an open and closed position across the window.

42. A security closure as claimed at claim 1 wherein the opening comprises a doorway and the closure comprises a door which can be selectively moved between an open and closed position across the doorway.

* * * * *